US008013530B2

(12) United States Patent
Yoo et al.

(10) Patent No.: US 8,013,530 B2
(45) Date of Patent: Sep. 6, 2011

(54) PLASMA DISPLAY PANEL

(75) Inventors: Young-Gil Yoo, Suwon-si (KR); Kyeongwoon Chung, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 5 days.

(21) Appl. No.: 12/648,293

(22) Filed: Dec. 28, 2009

(65) Prior Publication Data

US 2011/0057556 A1 Mar. 10, 2011

Related U.S. Application Data

(60) Provisional application No. 61/240,106, filed on Sep. 4, 2009.

(51) Int. Cl.
*H01J 17/49* (2006.01)
*H01J 9/00* (2006.01)

(52) U.S. Cl. ..... 313/585; 313/582; 445/24

(58) Field of Classification Search ..... None
See application file for complete search history.

(56) References Cited

U.S. PATENT DOCUMENTS

| | | | | |
|---|---|---|---|---|
| 6,472,819 | B2 | 10/2002 | Carretti et al. | |
| 2004/0155267 | A1 | 8/2004 | Harada et al. | |
| 2006/0226778 | A1 | 10/2006 | Choo | |
| 2008/0018250 | A1 | 1/2008 | Kim et al. | |
| 2009/0140653 | A1* | 6/2009 | Son | 313/582 |
| 2009/0146568 | A1* | 6/2009 | Son et al. | 313/585 |
| 2010/0007586 | A1* | 1/2010 | Park et al. | 345/71 |
| 2010/0090582 | A1* | 4/2010 | Okishiro et al. | 313/486 |

FOREIGN PATENT DOCUMENTS

| | | | |
|---|---|---|---|
| JP | 2002-358892 | | 12/2002 |
| JP | 2008-027597 | | 2/2008 |
| KR | 1020010049126 | A | 6/2001 |
| KR | 1020010091313 | A | 10/2001 |
| KR | 1020040058632 | A | 7/2004 |
| KR | 1020050114064 | A | 12/2005 |
| KR | 1020060058226 | A | 5/2006 |
| KR | 1020070091376 | A | 9/2007 |
| KR | 1020090009721 | A | 1/2009 |

OTHER PUBLICATIONS

European Extended Search Report for corresponding EP application No. 10152771.1-2008, dated Jun. 27, 2011, 7 pages.

* cited by examiner

*Primary Examiner* — Ashok Patel
(74) *Attorney, Agent, or Firm* — Christie, Parker & Hale, LLP

(57) ABSTRACT

A plasma display panel (PDP) having improved discharge efficiency, low discharge firing voltage, and high reliability. A plasma display device according to an embodiment of the present invention includes a first substrate and a second substrate spaced apart and facing each other. A plurality of address electrodes are between the first and second substrates. A plurality of barrier ribs are between the first and second substrates and define a plurality of discharge cells and a non-discharge region located between adjacent ones of the discharge cells. A carbon-based material is in the non-discharge region. A phosphor layer is in the plurality of discharge cells. A plurality of display electrodes are between the first and second substrates and extend in a direction crossing the address electrodes.

20 Claims, 4 Drawing Sheets

PLASMA DISPLAY PANEL

RELATED APPLICATIONS

This application claims priority to and the benefit of Provisional Patent Application No. 61/240,106 filed in the U.S. Patent and Trademark Office on Sep. 4, 2009, the entire content of which is incorporated herein by reference.

BACKGROUND

1. Field

This disclosure relates to a plasma display panel (PDP).

2. Description of the Related Art

A plasma display panel (PDP) is a display device that realizes an image by gas discharge. Plasma generated by gas discharge radiates vacuum ultraviolet (VUV) rays, and the VUV rays excite phosphor in the PDP. The excited phosphor generates visible lights of red (R), green (G) and blue (B) while being stabilized from their excited states.

The discharge efficiency of a PDP may be different according to the kind and content of its discharge gas. The discharge efficiency may be raised by increasing the content of xenon (Xe) amongst the discharge gas. In this case, however, the discharge initiation voltage is increased, and low discharge may result due to a delay in data voltage.

In addition, after a PDP is sealed airtight, impure gas may be generated in the space inside the PDP. The impure gas may not only deteriorate discharge efficiency but also increase a discharge initiation voltage.

SUMMARY

Aspects of embodiments of the present invention are directed toward a plasma display panel (PDP) having improved discharge efficiency, low discharge firing voltage, and high reliability.

According to an embodiment of the present invention, a plasma display device includes: a first substrate and a second substrate spaced apart and facing each other; a plurality of address electrodes between the first and second substrates; a plurality of barrier ribs between the first and second substrates and defining a plurality of discharge cells and a non-discharge region located between adjacent ones of the discharge cells and the non-discharge region having a carbon-based material therein; a phosphor layer in the plurality of discharge cells; and a plurality of display electrodes between the first and second substrates and extending in a direction crossing the address electrodes.

The carbon-based material may be a porous material. The porous material may have a surface area between about 500 $m^2/g$ and about 1500 $m^2/g$. The plurality of barrier ribs may include a plurality of first barrier rib members extending in a same direction as the address electrodes and a plurality of second barrier rib members extending in a same direction as the display electrodes. Adjacent ones of the second barrier rib members may be spaced apart between adjacent ones of the discharge cells to form the non-discharge region.

The non-discharge region may include a plurality of non-discharge spaces, and each of the non-discharge spaces may be surrounded by the barrier ribs. Each of the non-discharge spaces may overlap with a space between corresponding pairs of the display electrodes. The carbon-based material may include a material selected from the group consisting of coal, carbon black, graphite, activated carbon, and combinations thereof. The plasma display device may further include a discharge gas between the first and second substrates, and the discharge gas may have about 11% or more xenon in content. The plasma display device may further include a MgO layer having an oxygen vacancy structure on the second substrate and covering the display electrodes.

According to another embodiment of the present invention, a method of fabricating a plasma display device including a first substrate and a second substrate spaced apart and facing each other. The method include: forming a plurality of address electrodes on the first substrate; forming a plurality of barrier ribs between the first and second substrates to define a plurality of discharge cells and a non-discharge region located between adjacent ones of the discharge cells and the non-discharge region having a carbon-based material therein; forming a phosphor layer in the plurality of discharge cells; and forming a plurality of display electrodes between the first and second substrates. The display electrodes extend in a direction crossing the address electrodes.

DETAILED DESCRIPTION

Figure 1:
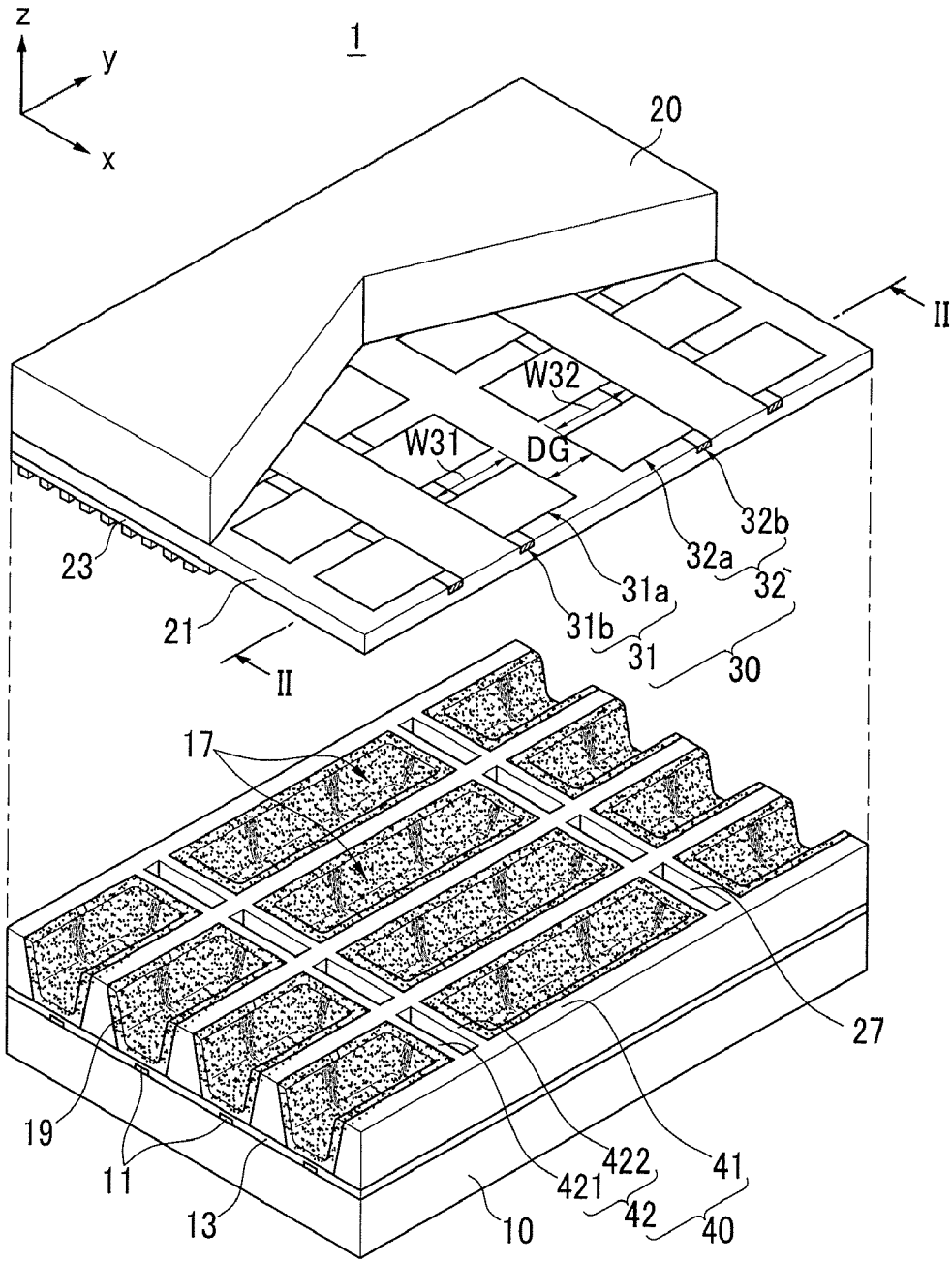
FIG. 1 is an exploded perspective view of a portion of a plasma display panel (PDP) according to one embodiment.

This disclosure will be described more fully hereinafter with reference to the accompanying drawings, in which exemplary embodiments of this disclosure are shown. As those skilled in the art would realize, the described embodiments may be modified in various different ways, all without departing from the spirit or scope of this disclosure. The drawings and description are to be regarded as illustrative in nature and not restrictive. Like reference numerals designate like elements throughout the specification.

Hereafter, a plasma display panel (PDP) will be described in accordance with an exemplary embodiment with reference to FIGS. 1 to 3.

Figure 2:
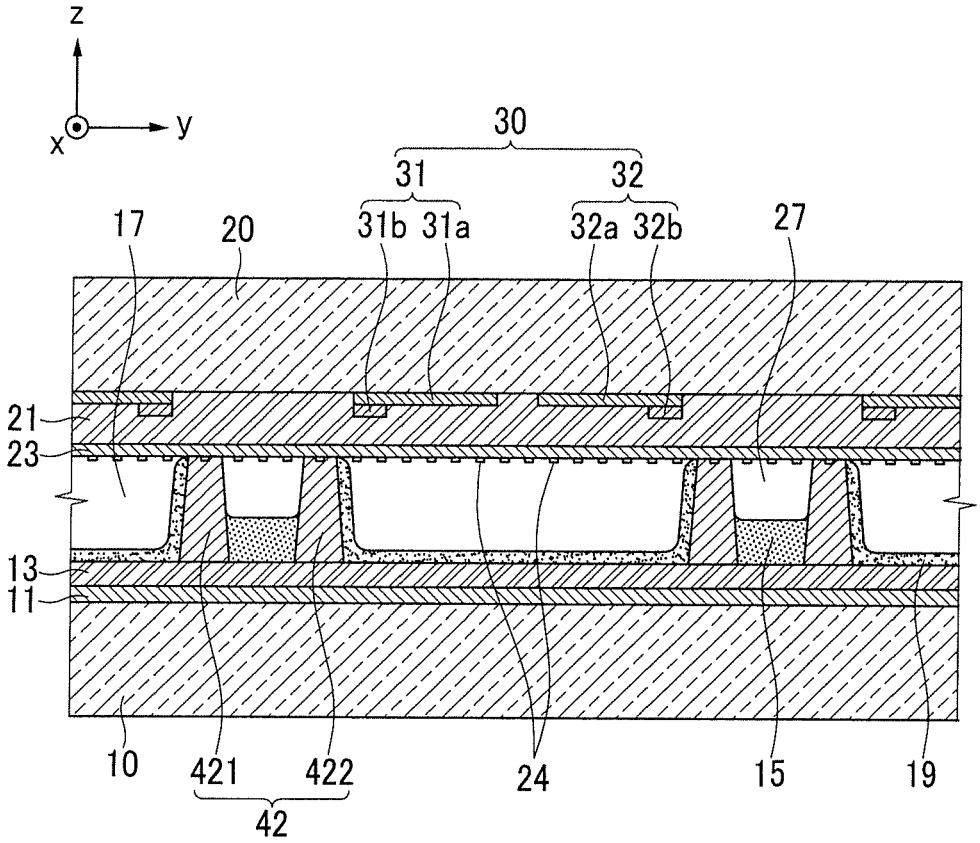
FIG. 2 is a cross-sectional view taken along the line II-II of FIG. 1.
Figure 3:
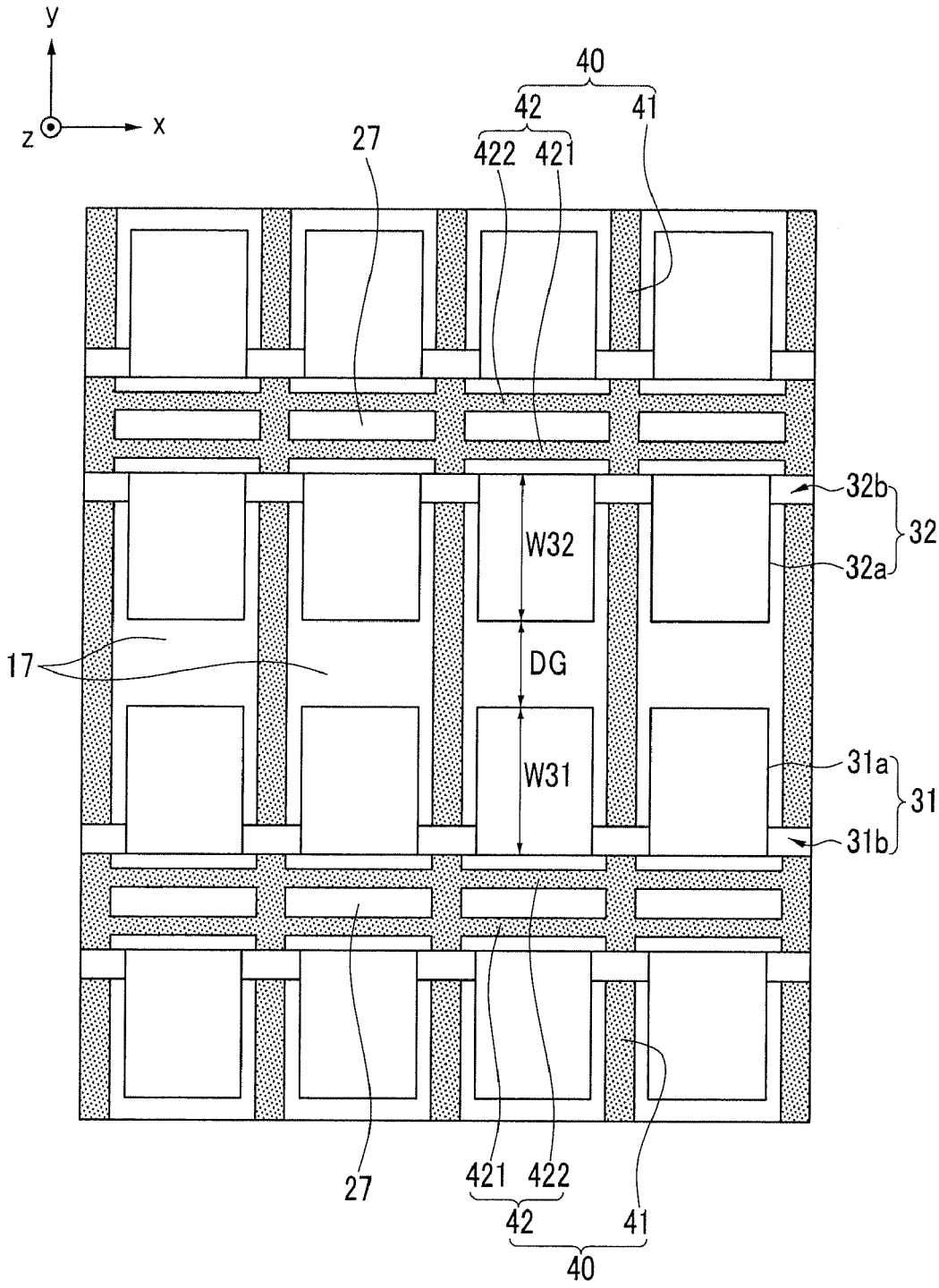
FIG. 3 is a top plan view showing an arrangement relationship between barrier ribs and electrodes of FIG. 1.

FIG. 1 is an exploded perspective view of a portion of a PDP according to one embodiment, FIG. 2 is a cross-sectional view taken along the II-II line of FIG. 1, and FIG. 3 is a top plan view showing an arrangement relationship between barrier ribs and electrodes of FIG. 1.

Referring to FIGS. 1 and 2, the PDP 1 includes a rear substrate 10 and a front substrate 20 disposed to face each other, and barrier ribs 40 disposed between the two substrates 10 and 20. The barrier ribs 40 partition a space between the rear substrate 10 and front substrate 20 to form a plurality of discharge cells 17.

A plurality of address electrodes 11 and a plurality of display electrodes 30 are disposed between the rear substrate 10 and the front substrate 20 to face the discharge cells 17.

The address electrodes 11 are formed on the internal surface of the rear substrate 10 to be extended in a first direction (which is a y-axis direction in the drawing), and continuously correspond to the adjacent discharge cells 17 in the y-axis direction.

The address electrodes 11 are arranged side by side in a second direction (which is an x-axis direction in the drawing) crossing the y-axis direction in correspondence with adjacent discharge cells 17. The address electrodes 11 do not hinder the transmission of visible lights through the front substrate 20 because the address electrodes 11 are disposed on the rear substrate 10. Therefore, the address electrodes 11 may be formed of an opaque electrode, that is, for example, a metal having excellent electrical conductivity, such as silver (Ag).

The display electrodes 30 may include a sustain electrode 31 and a scan electrode 32.

The sustain electrode 31 and the scan electrode 32 correspond to the discharge cells 17, and they are formed on the internal surface of the front substrate 20. The sustain electrode 31 and the scan electrode 32 form a surface discharge structure in correspondence to the discharge cells 17 so that gas discharge occurs in each discharge cell 17.

Referring to FIG. 3, the sustain electrode 31 and the scan electrode 32 are formed to be extended in the x-axis direction crossing the address electrode 11.

The sustain electrode 31 and the scan electrode 32 include transparent electrodes 31*a* and 32*a*, respectively, for performing a discharge and bus electrodes 31*b* and 32*b*, respectively, for applying a voltage signal to the transparent electrodes 31*a* and 32*a*, respectively.

Since significant portions of the transparent electrodes 31*a* and 32*a* are located in the central part of the discharge cells 17, they are formed of a transparent material, e.g., indium tin oxide (ITO), to obtain a suitable aperture ratio of the discharge cells 17. The bus electrodes 31*b* and 32*b* may be formed of a metal to ensure excellent electrical conductivity so that they can apply a voltage signal to the transparent electrodes 31*a* and 32*a*.

The transparent electrodes 31*a* and 32*a* are formed to be protruded from the edges of the discharge cells 17 toward the centers of the discharge cells 17 in the y-axis direction so that they are located near the central part of the discharge cells 17. In short, the transparent electrodes 31*a* and 32*a* have widths W31 and W32, respectively, in the y-axis direction, and form a discharge gap (DG) between them.

The bus electrodes 31*b* and 32*b* extend in the x-axis direction from both sides of the discharge cells 17 in the y-axis direction and are located on the transparent electrodes 31*a* and 32*a*, respectively. Therefore, the voltage signals applied to the bus electrodes 31*b* and 32*b* are applied to the transparent electrodes 31*a* and 32*a*, respectively, corresponding to the discharge cells 17 through the bus electrodes 31*b* and 32*b*.

The first dielectric layer 13 covers the internal surface of the rear substrate 10 and the address electrodes 11. The first dielectric layer 13 protects the address electrodes 11 from being damaged from gas discharge, and provides a place where wall charges are formed and accumulated for discharge. In short, the first dielectric layer 13 prevents positive ions or electrons from directly colliding with the address electrodes 11 during discharge to thereby protect the address electrodes 11.

The second dielectric layer 21 covers the inside surface of the front substrate 20, the sustain electrode 31, and the scan electrode 32. The second dielectric layer 21 protects the sustain electrode 31 and the scan electrode 32 from the positive ions or electrons generated during the discharge, and provides a place where wall charges are formed and accumulated for discharge.

The protective layer 23 covers the second dielectric layer 21. For example, when the protective layer 23 is formed of transparent magnesium oxide (MgO) that allows visible lights to be transmitted therethrough, it can protect the second dielectric layer 21 from positive ions or electrons generated during the discharge and increases a secondary electron emission coefficient during the discharge.

The barrier ribs 40 include first barrier rib members 41 and second barrier rib members 42. The first barrier rib members 41 are extended in the y-axis direction and partition the discharge cells 17 in the x-axis direction. The second barrier rib members 42 are extended in the x-axis direction and partition the discharge cells 17 in the y-axis direction. The first and second barrier rib members 41 and 42 form the discharge cells 17 in a matrix structure according to one embodiment.

Also, the second barrier rib member 42 includes barrier rib members 421 and 422 that are spaced apart between adjacent discharge cells 17 in the y-axis direction to thereby form a non-discharge space 27 between the barrier rib members 421 and 422.

Each of the discharge cells 17 formed by the barrier ribs 40 includes a phosphor layer 19. The phosphor layer 19 is excited by vacuum ultraviolet (VUV) ray and radiates red (R), green (G) and blue (B) visible lights while being stabilized from its excited state.

The phosphor layer 19 may be formed by coating the side surfaces of the barrier ribs 40 and the surface of the first dielectric layer 13 surrounded by the barrier ribs 40 with a phosphor paste and drying and baking the phosphor paste.

The phosphor layer 19 is formed of a phosphor for generating visible lights of the same color in the discharge cells 17 formed along the y-axis direction. The phosphor layer 19 is formed of a phosphor for generating visible lights of red (R), green (G) and blue (B), respectively, in the discharge cells 17 arrayed repeatedly along the x-axis direction. The phosphor layer 19 formed of a phosphor for generating visible lights of red (R), green (G) and blue (B), respectively, is repeated along the x-axis direction.

The discharge cells 17 formed by the barrier rib 40 are filled with a discharge gas.

The discharge gas generates vacuum ultraviolet (VUV) ray through a gas discharge. Non-limiting examples of the discharge gas include neon (Ne), xenon (Xe), and combinations thereof. Herein, when the content of Xe is higher, discharge efficiency increases. The content of Xe may be equal to or higher than about 11% based on the total content of the discharge gas.

A PDP realizes an image by selecting discharge cells 17 to be turned on through an address discharge caused by the address electrodes 11 and the scan electrodes 32 and driving the selected discharge cells 17 through a sustain discharge caused by the sustain electrodes 31 and the scan electrodes 32 arrayed in the selected discharge cells 17.

In addition, the PDP 1 according to an exemplary embodiment includes a carbon-containing layer 15 in a region other than the discharge cells 17. Herein, the region other than the discharge cells 17, which will be referred to as a "non-discharge area" hereinafter, is an area where discharge does not occur in a display region where an image is shown, and it includes the non-discharge space 27 and a portion corresponding to the barrier ribs 40.

The carbon-containing layer 15 includes a carbon-based material.

According to an embodiment, the carbon-based material may be a porous material having a wide surface area of about 500 $m^2/g$ to about 1,500 $m^2/g$. The carbon-based material may be oxidized at a high temperature, for example during the sealing of panels of the PDP 1 and gas exhaustion, to thereby generate a gas such as carbon dioxide $CO_2$. During the oxidation of the carbon-based material, oxygen vacancy may occur in the magnesium oxide (MgO) of the protective layer 23, and it may decrease the discharge voltage. Non-limiting examples of the carbon-based material include coal, carbon black such as fluid catalytic cracking (FCC) carbon black, graphite, activated carbon and combinations thereof.

In addition, in this embodiment, the carbon-containing layer 15 is disposed in the non-discharge area, which is the region other than the discharge cells 17. When the carbon-containing layer 15 is disposed in the discharge cell 17, the impurities adsorbed to the carbon-based material—may be released back to a discharge area due to an increase in temperature originated from plasma discharge and ion collision. However, since the carbon-containing layer 15 is formed in the non-discharge area according to the present embodiment, the impurities are kept away from being released to the discharge area. Thus, it is possible to prevent the discharge initiation voltage from increasing due to the release of the impurities during continuous driving of the PDP 1.

Also, the carbon-based material forming the carbon-containing layer 15 is generally a luminance-decreasing material such as a black color material. When the carbon-based material is disposed in the discharge cells 17, the luminance of visible lights generated from the phosphor is decreased to thereby deteriorate light output efficiency of the PDP 1. Since the carbon-based material is disposed in the non-discharge area according to the present embodiment of this disclosure, the light output efficiency may be protected or prevented from being deteriorated.

Part of the carbon-containing layer 15 is evaporated during an aging process of the PDP 1, and the particles 24 of evaporated carbon-based material may be attached to the surface of the protective layer 23.

The aforementioned effect of decreasing discharge voltage will be described more fully with reference to FIG. 4.

Figure 4:
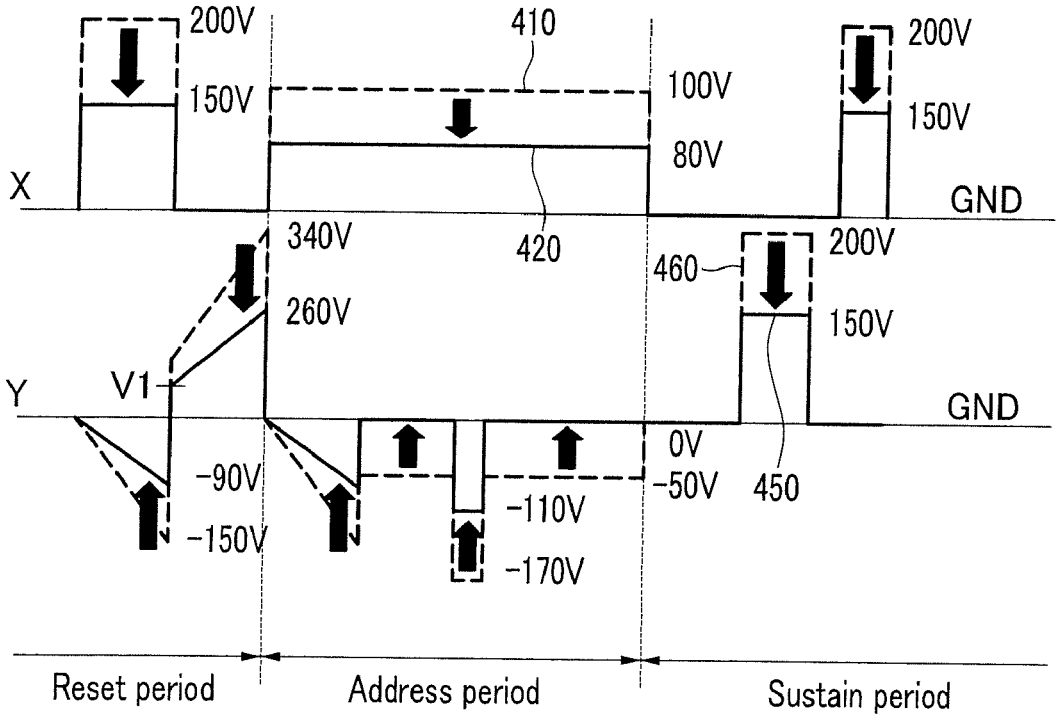
FIG. 4 is a driving waveform diagram of a PDP according to one embodiment.

FIG. 4 shows a driving waveform diagram of a PDP according to an exemplary embodiment.

Referring to FIG. 4, a waveform 410 and a waveform 460 show driving waveforms of voltages applied to an X electrode and a Y electrode of a typical PDP, respectively. A waveform 420 and a waveform 450 show driving waveforms of voltages applied to an X electrode and a Y electrode of a PDP manufactured according to an embodiment of the present disclosure, respectively. A driving waveform of voltage applied to the Y electrode and the X electrode forming one discharge cell will be described with reference to FIG. 4.

Hereafter, the waveform 410 and the waveform 460 will be described with reference to FIG. 4.

While a predetermined voltage, which is 200V, is applied to the X electrode in the falling section of the reset period, the voltage of the Y electrode is gradually decreased from the ground voltage to −150V. In FIG. 4, the voltage of the Y electrode may be decreased in a ramp pattern. While the voltage of the Y electrode is gradually decreased, a weak discharge occurs between the Y electrode and the X electrode, and accordingly the negative charges generated in the Y electrode and the positive charges generated in the X electrode during the rising section may be cancelled. Accordingly, a discharge cell may be initialized.

Subsequently, in the rising section of a reset period, a predetermined voltage, e.g., 0V, is applied to the X electrode, and the voltage of the Y electrode is gradually increased from the initial reset voltage, which is voltage V1, to 340 V. When the voltage of the Y electrode is gradually increased, weak discharge occurs between the Y electrode and the X electrode, and accordingly, negative charges may be generated in the Y electrode while positive charges may be generated in the X electrode.

In the following address period, to distinguish an on-cell from an off-cell, scan pulses having a scan voltage, e.g., −170V, are sequentially applied to the Y electrode while applying a predetermined voltage, e.g., 100V, to the X electrode. In the address period, an address discharge occurs between the Y electrode and the address electrode (not shown), positive charges are generated in the Y electrode while negative charges are generated in the X electrode.

In the sustain period, a sustain discharge pulse alternately having a high voltage, e.g., 200V, and a low voltage, e.g., ground voltage, is applied in a reverse phase (i.e., alternately) to the Y electrode and the X electrode. In other words, when the high voltage is applied to the Y electrode while the low voltage is applied to the X electrode, a sustain discharge occurs in an on-cell due to the voltage difference between the high voltage and the low voltage, and subsequently, when the low voltage is applied to the Y electrode and the high voltage is applied to the X electrode, the sustain discharge may occur again in the on-cell due to the voltage difference between the high voltage and the low voltage.

When a weak discharge (e.g., reset discharge) is to occur during a reset period, the voltage difference between the X electrode and the Y electrode is required to be equal to or higher than the discharge initiation voltage. When it is to occur during an address period, the voltage difference between an address electrode and the Y electrode is required to be equal to or higher than an address discharge initiation voltage. Also, when sustain discharge is to occur during a sustain period, the voltage difference between the X electrode and the Y electrode is required be equal to or higher than a sustain discharge initiation voltage.

In the PDP 1 manufactured according to an exemplary embodiment, as shown in FIG. 4, the voltage applied to the X electrode during a reset period may be 150V and the voltage applied to the Y electrode during a reset period may range from −90V to 260V. Also, the voltages applied to the X electrode and the Y electrode in an address period may be 80V and −110V, respectively. Also, the voltages applied to the X electrode and Y electrode in a sustain period may be 150V. In short, it is possible to decrease the driving voltages applied to the X electrode and Y electrode of the PDP 1 according to the exemplary embodiment, compared to the driving voltages applied to the X electrode and Y electrode in the above-described typical PDP.

A PDP manufactured according to an exemplary embodiment may normally perform the aforementioned reset discharge, address discharge and sustain discharge, although it uses a decreased X-electrode driving voltage and a decreased Y-electrode driving voltage. In other words, with the PDP structure illustrated in FIGS. 1 to 3, it is possible to decrease the discharge initiation voltage to achieve a low voltage driving of the PDP. The low voltage driving leads to a decrease in power consumption.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A plasma display device comprising:

a first substrate and a second substrate spaced apart and facing each other;

a plurality of address electrodes between the first and second substrates;

a plurality of barrier ribs between the first and second substrates and defining a plurality of discharge cells and a non-discharge region located between adjacent ones of the discharge cells, the non-discharge region having a carbon-based material therein;

a phosphor layer in the plurality of discharge cells; and a plurality of display electrodes between the first and second substrates and extending in a direction crossing the address electrodes.

2. The plasma display device of claim 1, wherein the carbon-based material is a porous material.

3. The plasma display device of claim 2, wherein the porous material has a surface area between about 500 $m^2/g$ and about 1500 $m^2/g$.

4. The plasma display device of claim 1, wherein the plurality of barrier ribs comprises:

a plurality of first barrier rib members extending in a same direction as the address electrodes; and a plurality of second barrier rib members extending in a same direction as the display electrodes, wherein adjacent ones of the second barrier rib members are spaced apart between adjacent ones of the discharge cells to form the non-discharge region.

5. The plasma display device of claim 1, wherein the non-discharge region comprises a plurality of non-discharge spaces, and each of the non-discharge spaces is surrounded by the barrier ribs.

6. The plasma display device of claim 5, wherein each of the non-discharge spaces overlaps with a space between corresponding pairs of the display electrodes.

7. The plasma display device of claim 1, wherein the carbon-based material comprises a material selected from the group consisting of coal, carbon black, graphite, activated carbon, and combinations thereof.

8. The plasma display device of claim 1, further comprising a discharge gas between the first and second substrates and having about 11% or more xenon in content.

9. The plasma display device of claim 1, further comprising a MgO layer having an oxygen vacancy structure on the second substrate and covering the display electrodes.

10. A method of fabricating a plasma display device comprising a first substrate and a second substrate spaced apart and facing each other, the method comprising:

forming a plurality of address electrodes on the first substrate;

forming a plurality of barrier ribs between the first and second substrates to define a plurality of discharge cells and a non-discharge region located between adjacent ones of the discharge cells and the non-discharge region having a carbon-based material therein;

forming a phosphor layer in the plurality of discharge cells; and forming a plurality of display electrodes between the first and second substrates, the display electrodes extending in a direction crossing the address electrodes.

11. The method of claim 10, wherein the carbon-based material is a porous material.

12. The method of claim 11, wherein the porous material has a surface area between about 500 $m^2/g$ and about 1500 $m^2/g$.

13. The method of claim 10, wherein the forming the plurality of barrier ribs comprises:

forming a plurality of first barrier rib members extending in a same direction as the address electrodes; and forming a plurality of second barrier rib members extending in a same direction as the display electrodes, wherein adjacent ones of the second barrier rib members are spaced apart between adjacent ones of the discharge cells to form the non-discharge region.

14. The method of claim 10, wherein the non-discharge region comprises a plurality of non-discharge spaces, and each of the non-discharge spaces is surrounded by the barrier ribs.

15. The method of claim 14, wherein each of the non-discharge spaces overlaps with a space between corresponding pairs of the display electrodes.

16. The method of claim 10, wherein the carbon-based material comprises a material selected from the group consisting of coal, carbon black, graphite, activated carbon, and combinations thereof.

17. The method of claim 10, further comprising forming a discharge gas between the first and second substrates and having about 11% or more xenon in content.

18. The method of claim 10, further comprising removing impurities in the discharge cells by using the carbon-based material.

19. The method of claim 10, further comprising generating carbon dioxide in the discharge cells by oxidation of the carbon-based material during the sealing of the first and second substrates together or gas exhaustion of the plasma display device.

20. The method of claim 10, further forming a MgO layer having an oxygen vacancy structure on the second substrate and covering the display electrodes.

* * * * *